US007758393B2

(12) United States Patent
Lucier et al.

(10) Patent No.: US 7,758,393 B2
(45) Date of Patent: Jul. 20, 2010

(54) ENGINE MOUNT SYSTEM FOR A MARINE OUTBOARD ENGINE

(75) Inventors: Peter Lucier, Chicago, IL (US); Darrell Wiatrowski, Beach Park, IL (US); George Broughton, Wadsworth, IL (US); Glendon Chesser, Jr., Gurnee, IL (US)

(73) Assignee: BRP US Inc., Sturtevant, WI (US)

( * ) Notice: Subject to any disclaimer, the term of this patent is extended or adjusted under 35 U.S.C. 154(b) by 202 days.

(21) Appl. No.: 12/147,686

(22) Filed: Jun. 27, 2008

(65) Prior Publication Data

US 2009/0001244 A1 Jan. 1, 2009

Related U.S. Application Data

(60) Provisional application No. 60/947,101, filed on Jun. 29, 2007.

(51) Int. Cl.

| | |
|---|---|
| ***B63H 1/15*** | (2006.01) |
| ***B63H 21/30*** | (2006.01) |
| *B63H 5/20* | (2006.01) |
| *B63H 5/125* | (2006.01) |
| *B63H 20/08* | (2006.01) |

(52) U.S. Cl. ..... 440/52; 440/53

(58) Field of Classification Search ..... 440/49, 440/52, 53

See application file for complete search history.

(56) References Cited

U.S. PATENT DOCUMENTS

| | | | | |
|---|---|---|---|---|
| 2,549,486 | A * | 4/1951 | Kiekhaefer | 440/63 |
| 2,723,639 | A | 11/1955 | Hinrichs et al. | |
| 3,013,518 | A | 12/1961 | Smith | |
| 3,599,594 | A | 8/1971 | Taipale | |
| 3,613,631 | A * | 10/1971 | Wick et al. | 440/52 |
| 3,623,446 | A | 11/1971 | Shimanckas | |

(Continued)

FOREIGN PATENT DOCUMENTS

| | | | |
|---|---|---|---|
| JP | 62279190 | A2 | 4/1987 |

OTHER PUBLICATIONS

Shiomi et al.: Reducing Vibration of a 2-Cylinder Outboard Motor by the Pendulum Motion Mount Method, SAE Technical Paper Series 2001-01-1870/290, 2001.

(Continued)

*Primary Examiner*—Daniel V Venne
(74) *Attorney, Agent, or Firm*—Osler, Hoskin & Harcourt LLP

(57) ABSTRACT

A marine outboard engine has a cowling, an engine, a driveshaft operatively connected to the crankshaft, a gear case, a transmission disposed in the gear case and connected to the driveshaft, a propeller shaft disposed generally perpendicular to the driveshaft and operatively connected to the transmission, and a bladed rotor connected to the propeller shaft. A pair of engine mounts are operatively connected to the engine. Each engine mount defines an engine mount working axis. A steering shaft is operatively pivotally connected to the engine mounts. The engine mount working axes are generally perpendicular to the steering axis and pass through the steering shaft. A stern bracket is operatively pivotally connected to the steering shaft for mounting the outboard engine to a boat. A marine outboard engine where primary axes of the engine mounts pass through the steering shaft is also disclosed.

21 Claims, 7 Drawing Sheets

U.S. PATENT DOCUMENTS

| | | | |
|---|---|---|---|
| 3,774,571 | A | 11/1973 | Shimanckas |
| 4,521,201 | A | 6/1985 | Watanabe |
| 4,557,695 | A | 12/1985 | Neisen |
| 4,622,015 | A | 11/1986 | Sumigawa |
| 4,689,024 | A | 8/1987 | Ferguson |
| 4,701,141 | A | 10/1987 | Sumigawa |
| 4,826,460 | A | 5/1989 | Zuckerman |
| 5,105,924 | A | 4/1992 | Carlson |
| 5,190,488 | A | 3/1993 | Fujimoto |
| 5,194,025 | A | 3/1993 | Blanchard et al. |
| 6,146,221 | A | 11/2000 | Natsume |
| 6,174,211 | B1 | 1/2001 | Nakamura |
| 6,200,175 | B1 | 3/2001 | Natsume |
| 6,341,992 | B1 | 1/2002 | Eglinsdoerfer et al. |
| 6,648,703 | B2 | 11/2003 | McChesney et al. |
| 6,659,817 | B1 | 12/2003 | Anderson et al. |
| 7,168,383 | B2 | 1/2007 | Saito |
| 2002/0081918 | A1 | 6/2002 | Mineno et al. |

OTHER PUBLICATIONS

Shiomi et al., "Isolating Vibration Through Use of Traveling Center of Engine Oscillation", SAE Paper No. 911293, pp. 573-582, Japan. English Abstract of Japanese Application No. JP62279190.

* cited by examiner

ENGINE MOUNT SYSTEM FOR A MARINE OUTBOARD ENGINE

CROSS-REFERENCE

The present application claims priority to U.S. Provisional Application No. 60/947,101 filed Jun. 29, 2007, the entirety of which is incorporated herein by reference.

FIELD OF THE INVENTION

The present invention relates to an engine mount system. More specifically, the present invention relates to an engine mount system to be used in a marine outboard engine.

BACKGROUND OF THE INVENTION

As is well known, internal combustion engines generate vibrations during operation. These vibrations get transmitted to the vehicle or device to which they are mounted. Engine mounts are typically mounted between the engine and the vehicle or device to actively or passively reduce the transmission of the vibrations thereto. The effectiveness of the engine mounts is related to both their type and their location amongst other factors. Engine mounts will also typically be more effective over certain ranges of speed of the engine.

FIG. 1 schematically illustrates a top view of a typical engine mount system used in marine outboard engines. An engine 1 has a crankcase 3 and one or more cylinders 5 extending horizontally away from a boat (not shown) to which the marine outboard engine is mounted. A piston 7 is disposed in each cylinder 5. Each piston 7 is pivotally connected by a wristpin 9 to a connecting rod 11. Each connecting rod 11 connects its respective piston to a crankshaft 13 of the engine 1. The engine 1 is connected to a bracket 15 that is pivotally connected to a steering shaft 17 about which the outboard engine is pivoted to be steered. A tiller 19 extends from the bracket 15 to allow a user of the outboard marine engine to manually steer the outboard marine engine. Alternatively, the bracket 15 could be connected to a steering mechanism such as the steering wheel of a boat. A stern bracket (not shown) is pivotally connected to the steering shaft 17 and pivotally connects the marine outboard engine to the transom of the boat. Two or more engine mounts 21 are connected between the engine 1 and the bracket 15 to reduce the transmission of vibrations from the engine 1 to the tiller 19. The working axes 23 of the engine mounts 21 (i.e. the axes along which the engine mounts 21 absorb the vibrations) are arranged parallel to the cylinder axis 25.

The engine mounts 21 are arranged this way since at high engine speeds the engine 1 vibrates primarily in a fore and aft direction generally along the cylinder axis 25 (in an up down direction in FIG. 1). Thus having the working axis 23 of the engine mounts 21 arranged parallel to the direction of the vibration provides adequate damping for such engine operating speeds.

At low engine speeds however, the primary source of engine vibrations for an in-line engine 1 such as the one illustrated in FIG. 1 is what is known as torque-kick. Torque-kick is the reaction of the engine block (crankcase 3 and cylinder 5) to the force F on the wall of the cylinder 5 adjacent to the wrist pin 9 during combustion. This side force F is the result of the connecting rod 11 forming an angle with respect to the cylinder axis 25 while the piston 7 is loaded by combustion pressure in the direction of the cylinder axis 25. The torque-kick creates an alternating moment about the torque-roll axis 27 of the engine 1. This moment causes the engine 1 rotate/vibrate about the torque-roll axis 27. Therefore, by having the working axes 23 of the engine mounts 21 arranged as shown, the force reactions at the engine mounts 21 to the moment generated at low engine speeds are applied to a moment arm having a length D and create a moment M about the steering axis 29 of the steering shaft 17. This moment M generated about the steering axis 29 is then transmitted to the tiller 19 as vibrations.

Thus, although the engine mount system illustrated in FIG. 1 provides adequate vibration damping at high engine speeds, it provides less effective vibration damping at lower engine speeds where the primary source of engine vibrations is torque-kick.

Therefore, there is a need for an engine mount system for a marine outboard engine that better dampens vibrations due to torque-kick.

There is also a need for an engine mount system for a marine outboard engine that better dampens vibrations over a broad range of engine speeds.

SUMMARY OF THE INVENTION

It is an object of the present invention to ameliorate at least some of the inconveniences present in the prior art.

It is also an object of the present invention to provide a marine outboard engine having an engine mount system that better dampens vibrations due to torque-kick.

It another object of the present invention to provide a marine outboard engine having an engine mount system that better dampens vibrations over a broad range of engine speeds.

It yet another object of the present invention to provide a marine outboard engine where the working axes of the engine mounts pass through the steering shaft of the outboard engine.

It is also an object of the present invention to provide a marine outboard engine where the primary axes of the engine mounts pass through the steering shaft of the outboard engine.

In one aspect, the invention provides a marine outboard engine having a cowling, and an engine disposed in the cowling. The engine includes a crankcase, at least one cylinder connected to the crankcase, and a crankshaft disposed in the crankcase. The crankshaft defines a crankshaft axis. A driveshaft is disposed in the cowling generally parallel to the crankshaft axis. The driveshaft has a first end and a second end. The first end of the driveshaft is operatively connected to the crankshaft. A gear case is operatively connected to the cowling. A transmission is disposed in the gear case. The transmission is operatively connected to the second end of the driveshaft. A propeller shaft is disposed at least in part in the gear case generally perpendicular to the driveshaft. The propeller shaft is operatively connected to the transmission. A bladed rotor is connected to the propeller shaft. A first engine mount is operatively connected to a first side of the engine. The first engine mount defines a first engine mount working axis. A second engine mount is operatively connected to a second side of the engine. The second engine mount defines a second engine mount working axis. A steering shaft is operatively pivotally connected to the first and second engine mounts. The steering shaft defines a steering axis. The steering axis is generally parallel to the crankshaft axis. The first and second engine mount working axes are generally perpendicular to the steering axis. The first and second engine mount working axes pass through the steering shaft. A stem bracket is operatively pivotally connected to the steering shaft for mounting the outboard engine to a boat.

In an additional aspect, the first and second engine mount working axes pass through the steering shaft when an engine speed is less than an engine transition speed.

In a further aspect, the engine transition speed is less than 3000 rpm.

In an additional aspect, the first and second engine mount working axes pass through the steering axis.

In a further aspect, an exhaust housing is disposed in the cowling and is connected to the engine. The first engine mount is connected to a first side of the exhaust housing and the second engine mount is connected to a second side of the exhaust housing.

In an additional aspect, a first bracket is operatively pivotally connecting the steering shaft to the first and second engine mounts.

In a further aspect, the first bracket operatively pivotally connects a first end of the steering shaft to the first and second engine mounts. A third engine mount is connected to the first side of the exhaust housing. The third engine mount defines a third engine mount working axis. A fourth engine mount is operatively connected to the second side of the exhaust housing. The fourth engine mount defines a fourth engine mount working axis. A second bracket is operatively pivotally connecting a second end of the steering shaft to the third and fourth engine mounts. The third and fourth engine mount working axes are generally perpendicular to the steering axis and pass through the steering shaft.

In an additional aspect, a tiller is connected to the first bracket.

In a further aspect, when the engine is in operation, the engine generates torque about a torque-roll axis. The torque-roll axis is generally parallel to the crankshaft axis. The torque-roll axis is generally perpendicular to the first and second engine mount working axes.

In an additional aspect, the first and second engine mount working axes are spaced apart from the torque-roll axis.

In a further aspect, the first and second engine mounts each includes an elastomeric damper.

In an additional aspect, first and second engine mounts each further includes an outer sleeve, an inner sleeve, and a fastener. The inner sleeve is disposed inside the outer sleeve. The elastomeric damper is disposed between the outer sleeve and the inner sleeve. The fastener is disposed inside the inner sleeve. Each fastener fastens its corresponding engine mount to the first bracket.

In another aspect, the invention provides a marine outboard engine having a cowling, and an engine disposed in the cowling. The engine includes a crankcase, at least one cylinder connected to the crankcase, and a crankshaft disposed in the crankcase. The crankshaft defines a crankshaft axis. A driveshaft is disposed in the cowling generally parallel to the crankshaft axis. The driveshaft has a first end and a second end. The first end of the driveshaft is operatively connected to the crankshaft. A gear case is operatively connected to the cowling. A transmission disposed in the gear case. The transmission is operatively connected to the second end of the driveshaft. A propeller shaft is disposed at least in part in the gear case generally perpendicular to the driveshaft. The propeller shaft is operatively connected to the transmission. A bladed rotor is connected to the propeller shaft. A first engine mount is operatively connected to a first side of the engine. The first engine mount has a first primary axis and includes a first fastener. The first fastener defines a first fastener axis. A second engine mount is operatively connected to a second side of the engine. The second engine mount has a second primary axis and includes a second fastener. The second fastener defines a second fastener axis. A first bracket is fastened to the first and second engine mounts by the first and second fasteners. A steering shaft is operatively pivotally connected to the first bracket. The steering shaft defines a steering axis. The steering axis is generally parallel to the crankshaft axis. The first and second primary axes are generally perpendicular to the steering axis. The first and second primary axes pass through the steering shaft. A stem bracket is operatively pivotally connected to the steering shaft for mounting the outboard engine to a boat.

In a further aspect, the first and second primary axes pass through the steering axis.

In an additional aspect, an exhaust housing is disposed in the cowling and is connected to the engine. The first engine mount is connected to a first side of the exhaust housing and the second engine mount is connected to a second side of the exhaust housing.

In a further aspect, the first bracket operatively pivotally connects a first end of the steering shaft to the first and second engine mounts. A third engine mount is connected to the first side of the exhaust housing. The third engine mount has a third primary axis and includes a third fastener. The third fastener defines a third fastener axis. A fourth engine mount is operatively connected to the second side of the exhaust housing. The fourth engine mount has a fourth primary axis and includes a fourth fastener. The fourth fastener defines a fourth fastener axis. A second bracket is fastened to the third and fourth engine mounts by the third and fourth fasteners. The second bracket is operatively pivotally connected to a second end of the steering shaft. The third and fourth primary axes are generally perpendicular to the steering axis and pass through the steering shaft.

In an additional aspect, a tiller is connected to the first bracket.

In a further aspect, the first and second engine mounts each includes an elastomeric damper.

In an additional aspect, the first and second engine mounts each further includes an outer sleeve, and an inner sleeve disposed inside the outer sleeve. The elastomeric damper is disposed between the outer sleeve and the inner sleeve. Each of the first and second fasteners is disposed inside the inner sleeve of its corresponding engine mount.

In a further aspect, the first fastener axis is coaxial with the first primary axis, and the second fastener axis is coaxial with the second primary axis.

In an additional aspect, the first engine mount defines a first engine mount working axis, and the second engine mount defines a second engine mount working axis. The first and second engine mount working axes are generally perpendicular to the steering axis. The first and second engine mount working axes pass through the steering shaft.

For purposes of this application, the terms "working axis" refer to the axis along which an engine mount absorbs vibrations. Also, the terms "primary axis" refer to the axis along which an engine mount is the most elastic. The terms "engine transition speed" refer to the engine speed at which the primary cause of engine vibrations changes from torque-kick to the inertia of the piston(s). Finally, description of the spatial orientation of the various elements described herein is being made relative to a position of the marine outboard engine where the driveshaft is in a vertical orientation. It should be understood that should the orientation of the marine outboard engine change, such as when the marine outboard engine is trimmed or tilted, the description of the spatial orientation of the various elements should still be understood with respect to the orientation of the driveshaft representing the vertical orientation.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

Figure 2:
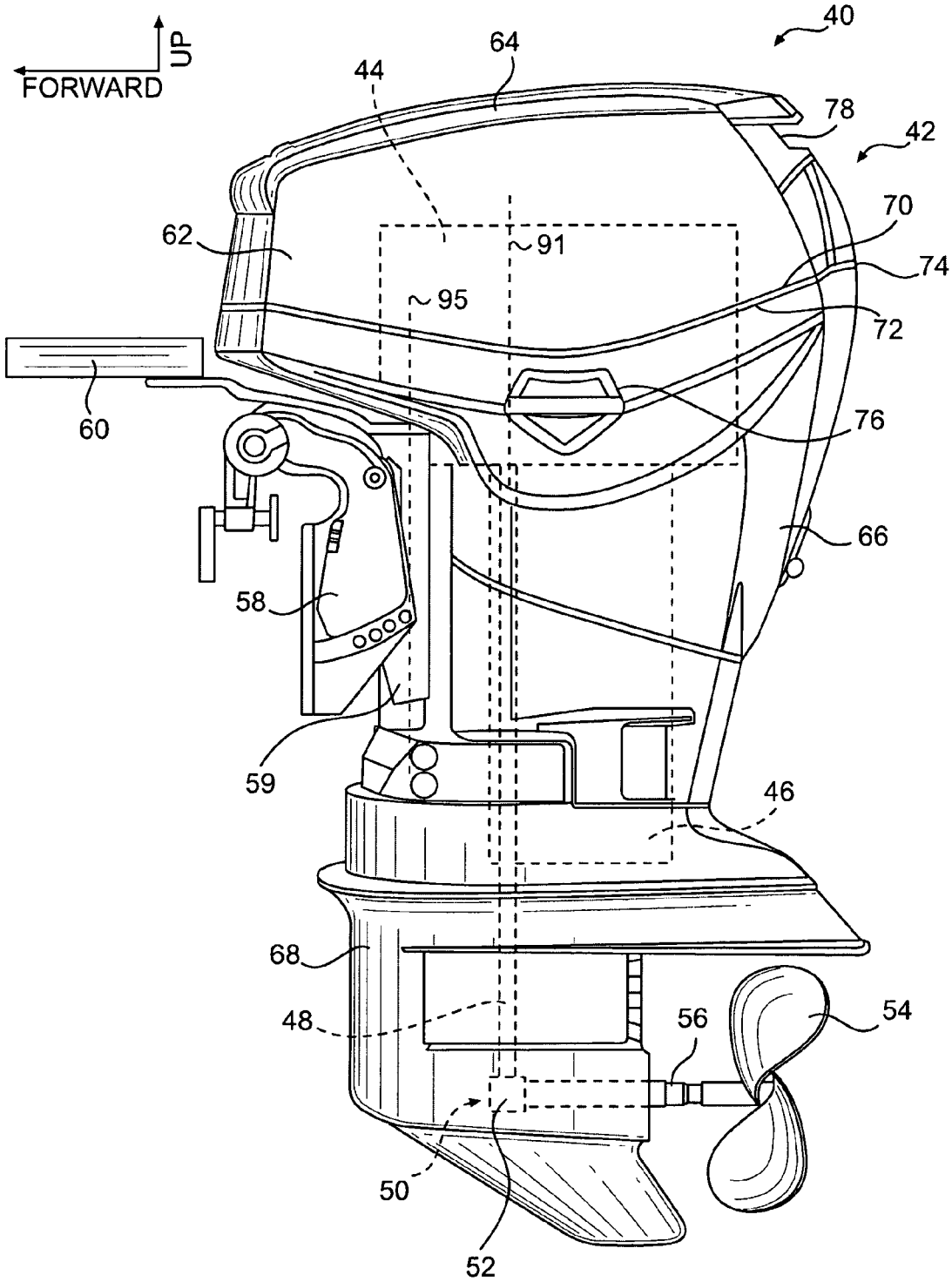
FIG. 2 is side elevation view of a marine outboard engine according to the present invention.

Referring to the figures, FIG. 2 is a side view of a marine outboard engine 40 having a cowling 42. The cowling 42 surrounds and protects an engine 44, shown schematically. Engine 44 is a conventional two-stroke internal combustion engine, such as an in-line two-stroke, two-cylinder engine. It is contemplated that other types of engine 44 could be used, such as a four-stroke engine. An exhaust system 46, shown schematically, is connected to the engine 44 and is also surrounded by the cowling 42.

The engine 44 is coupled to a vertically oriented driveshaft 48. The driveshaft 48 is coupled to a drive mechanism 50, which includes a transmission 52 and a bladed rotor, such as a propeller 54 mounted on a propeller shaft 56. The propeller shaft 56 is generally perpendicular to the driveshaft 48. The drive mechanism 50 could also include a jet propulsion device, turbine or other known propelling device. The bladed rotor could also be an impeller. Other known components of an engine assembly are included within the cowling 42, such as a starter motor and an alternator. As it is believed that these components would be readily recognized by one of ordinary skill in the art, further explanation and description of these components will not be provided herein.

A stem bracket 58 is connected to the cowling 42 via the swivel bracket 59 for mounting the outboard engine 40 to a watercraft. The stem bracket 58 can take various forms, the details of which are conventionally known. The swivel bracket 59 houses a steering shaft 94 (FIG. 6) of the outboard engine 40.

A tiller 60 is operatively connected to the cowling 42, as described in greater detail below, to allow manual steering of the outboard engine 40. It is contemplated that other steering mechanisms could be provided to allow steering, such as the steering wheel of a boat.

The cowling 42 includes several primary components, including an upper motor cover 62 with a top cap 64, and a lower motor cover 66. A lowermost portion, commonly called the gear case 68, is attached to the exhaust housing 69 (FIG. 4) which forms part of the exhaust system 46. The upper motor cover 62 preferably encloses the top portion of the engine 44. The lower motor cover 66 surrounds the remainder of the engine 44 and the exhaust system 46. The gear case 68 encloses the transmission 52 and supports the drive mechanism 50, in a known manner. The propeller shaft 56 extends from the gear case 68 and supports the propeller 54.

The upper motor cover 62 and the lower motor cover 66 are made of sheet material, preferably plastic, but could also be metal, composite or the like. The lower motor cover 66 and/or other components of the cowling 42 can be formed as a single piece or as several pieces. For example, the lower motor cover 66 can be formed as two lateral pieces that mate along a vertical joint. The lower motor cover 66, which is also made of sheet material, is preferably made of composite, but could also be plastic or metal. One suitable composite is fiberglass.

A lower edge 70 of the upper motor cover 62 mates in a sealing relationship with an upper edge 72 of the lower motor cover 66. A seal 74 is disposed between the lower edge 70 of the upper motor cover 62 and the upper edge 72 of the lower motor cover 66 to form a watertight connection.

A locking mechanism 76 is provided on at least one of the sides of the cowling 42. Preferably, locking mechanisms 76 are provided on each side of the cowling 10.

Figure 1:
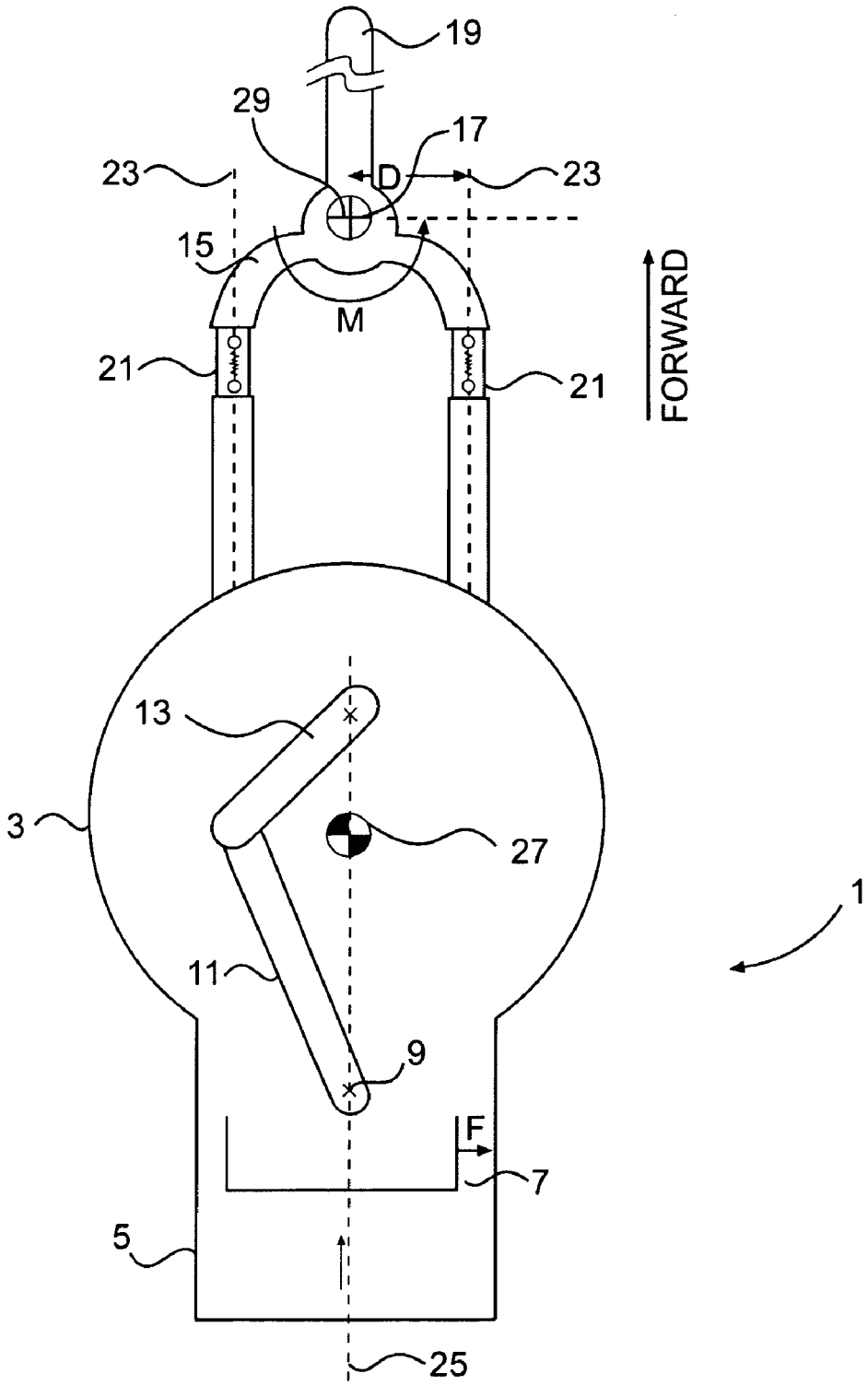
FIG.1 PRIOR ART
FIG. 1 is a schematic illustration of a top view of a prior art engine mount system for a marine outboard engine.

The upper motor cover 62 is formed with two parts, but could also be a single cover. As seen in FIG. 1, the upper motor cover 62 includes an air intake portion 78 formed as a recessed portion on the rear of the cowling 42. The air intake portion 78 is configured to prevent water from entering the interior of the cowling 42 and reaching the engine 44. Such a configuration can include a tortuous path. The top cap 64 fits over the upper motor cover 62 in a sealing relationship and preferably defines a portion of the air intake portion 78. Alternatively, the air intake portion 78 can be wholly formed in the upper motor cover 62 or even the lower motor cover 66.

Figure 3:
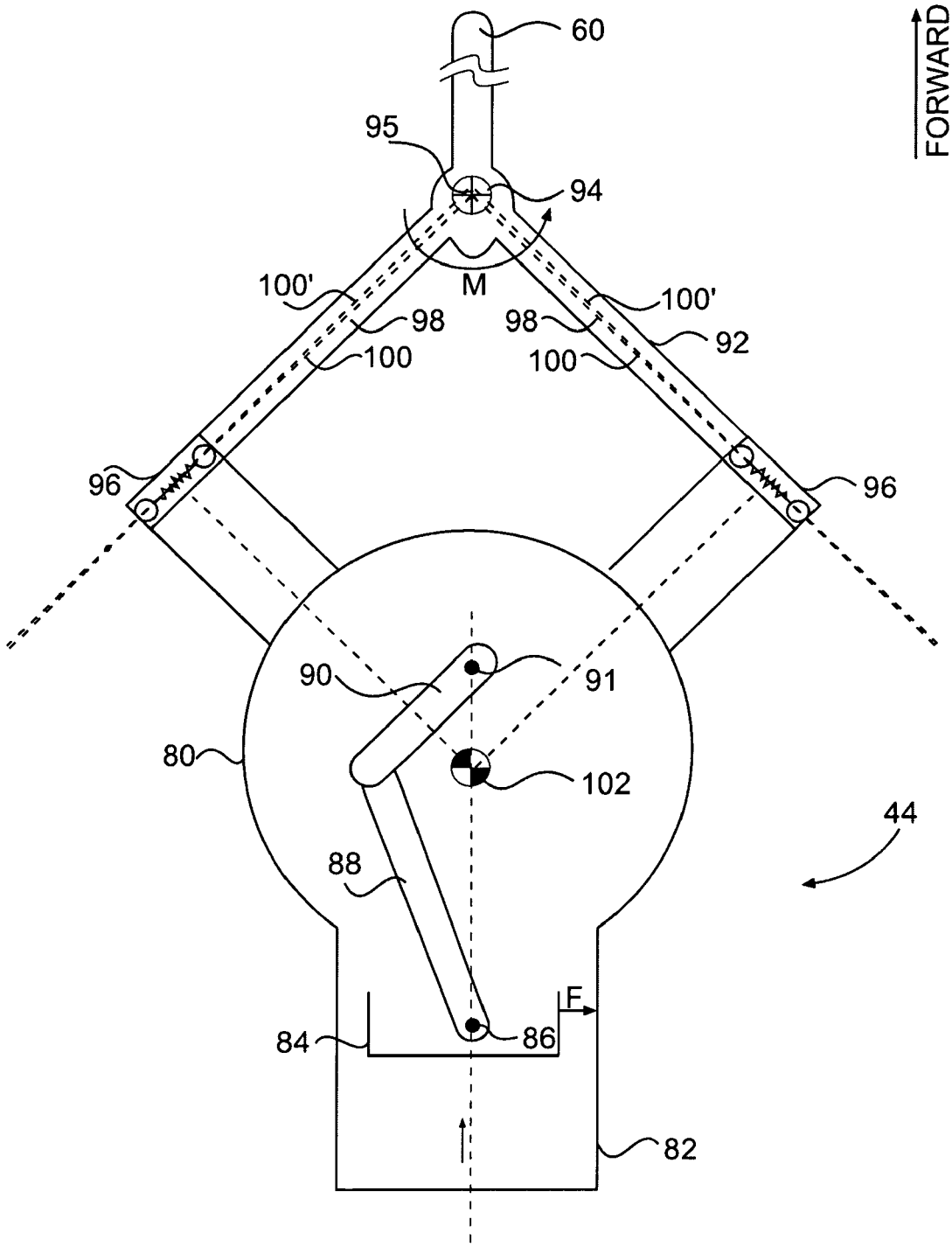
FIG. 3 is a schematic illustration of a top view of the engine mount system the marine outboard engine of FIG. 2.

To facilitate understanding, a schematic illustration of a top view of an engine mount system used in the marine outboard engine 40 of FIG. 2 is shown in FIG. 3. The engine 44 has a crankcase 80 and one or more cylinders 82 extending in line horizontally away from a boat (not shown) to which the marine outboard engine 40 is mounted. It is contemplated that the one or more cylinders 82 could extend in the opposite direction. A piston 84 is disposed in each cylinder 82. Each piston 84 is pivotally connected by a wristpin 86 to a connecting rod 88. Each connecting rod 88 connects its respective piston to a crankshaft 90 of the engine 44. The crankshaft 90 defines a generally vertical crankshaft axis 91. The crankshaft 90 is operatively connected to the driveshaft 48 such that the driveshaft 48 is generally parallel to the crankshaft axis 91. The engine 44 is connected to a bracket 92 that is pivotally connected to the steering shaft 94 about which the outboard engine 40 is pivoted to be steered. The steering shaft 94 defines a steering axis 95 that is generally parallel to the crankshaft axis 91. The tiller 60 extends from the bracket 92. Alternatively, the bracket 92 could be connected to a steering mechanism such as the steering wheel of a boat. Engine mounts 96 are connected between the engine 44 and the bracket 92 to reduce the transmission of vibrations from the engine 44 to the tiller 60.

The engine mounts 96 each have a primary axis 98. The primary axis 98 of each engine mount 96 corresponds to the axis along which the engine mount 96 is the most elastic. The generally horizontal primary axes 98 of the engine mounts 96 are generally perpendicular to the vertical crankshaft and steering axes 91, 95 respectively. As can be seen in FIG. 3, the primary axes 98 pass through the steering shaft 94 (i.e. they pass inside a periphery of the steering shaft 94). In a preferred embodiment, the primary axes 98 pass through the steering axis 95.

The engine mounts 96 also each have a working axis 100. The working axis 100 of each engine mount 96 corresponds the axis along which each engine mount 96 absorbs the vibrations from the engine 44. The generally horizontal working axes 100 of the engine mounts 96 are generally perpendicular to the vertical crankshaft and steering axes 91, 95 respectively. Although the working axes 100 are shown as corresponding to the primary axes 98, it should be understood that the actual orientation of the working axes 100 changes with the engine speed. For example, at low engine speeds when the primary source of vibrations is due to torque-kick, the working axes 100 intersect at a first position, but as the engine speed increases and the primary source of engine vibrations is the inertia of the piston(s) 84 (in the fore and aft direction), the working axes (now labeled 100') intersect at a second position forward of the first position (above on FIG. 3). As can be seen in FIG. 3, the working axes 100 pass through the steering shaft 94 for at least some engine speeds. This would normally occur when the primary axes 98 of the engine mounts 96 are oriented as described above. The working axes 100 preferably pass through the steering shaft 94 at least when the engine speed is less than an engine transition speed. The engine transition speed is the engine speed below which the primary cause of engine vibrations is torque-kick and above which the primary cause of engine vibrations is the inertia of the piston (s) 84. At high engine speeds the inertia of the piston(s) causes a back and forth rocking of the engine 44. The engine transition speed is usually less than 3000 rpm. Also, the working axes 100 preferably pass through the steering axis 95 at some engine speed(s). In a preferred embodiment, the working axes 98 pass through the steering shaft 94 at all engine speeds. The range of positions of the working axes 100 can be controlled by properly selecting the material and geometry of the engine mounts 96 as would be understood by those skilled in the art. In a preferred embodiment, the engine mounts 96 are tuned to provide good damping in a frequency range of 20 to 40 Hz.

As mentioned previously, torque-kick creates an alternating moment about a torque-roll axis 102 of the engine 44. This moment causes the engine 44 rotate/vibrate about the torque-roll axis 102. The force reactions at the engine mounts 96 to the moment generated at low engine speeds creates a moment "M" about the steering axis 95. However, by having the working axes 100 of the engine mounts 96 passing through the steering shaft 94 as described above, the moment "M" created about the steering axis 95 is relatively small and therefore the engine mounts 96 significantly dampen the vibrations transmitted to the tiller 60. This is because the moment arm to which the force reactions at the engine mounts 96 are applied is relatively short (i.e. less than or equal to the radius of the steering shaft 94). Further, when the working axes 100 pass through the steering axis 95, there is no moment created about the steering axis 95 and therefore no vibrations associated therewith being transmitted to the tiller 60. Since the working axes 100 are generally perpendicular to and do not intersect the torque-roll axis 102, the rotation/vibration of the engine 44 about the torque-roll axis 102 at low engine speeds does not create a moment about a generally horizontal axis, which would otherwise result in a vibration in a vertical direction to be transmitted to the tiller.

Although the engine mount system effectively dampens the vibrations due to torque-kick at low engine speeds for the reasons described above, since the working axes 100 of the engine mounts 96 have a longitudinal component (vertical in FIG. 3), the engine mount system also dampens vibrations at higher engine speeds due to the fore and aft (up and down in FIG. 3) rocking of the engine 44.

Figure 4:
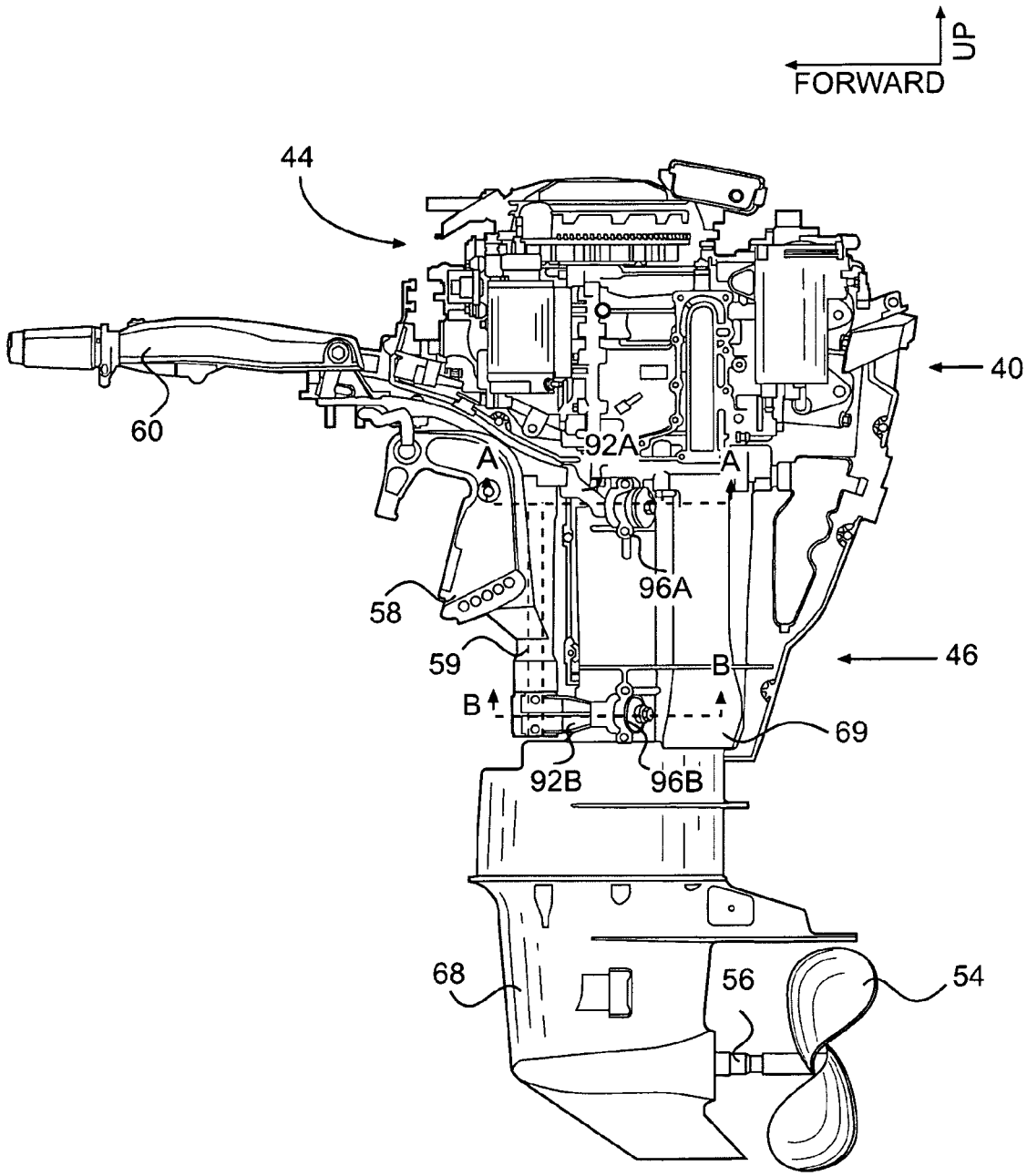
FIG. 4 is a side elevation view of the marine outboard engine of FIG. 2 with the cowling removed.
Figure 5A:
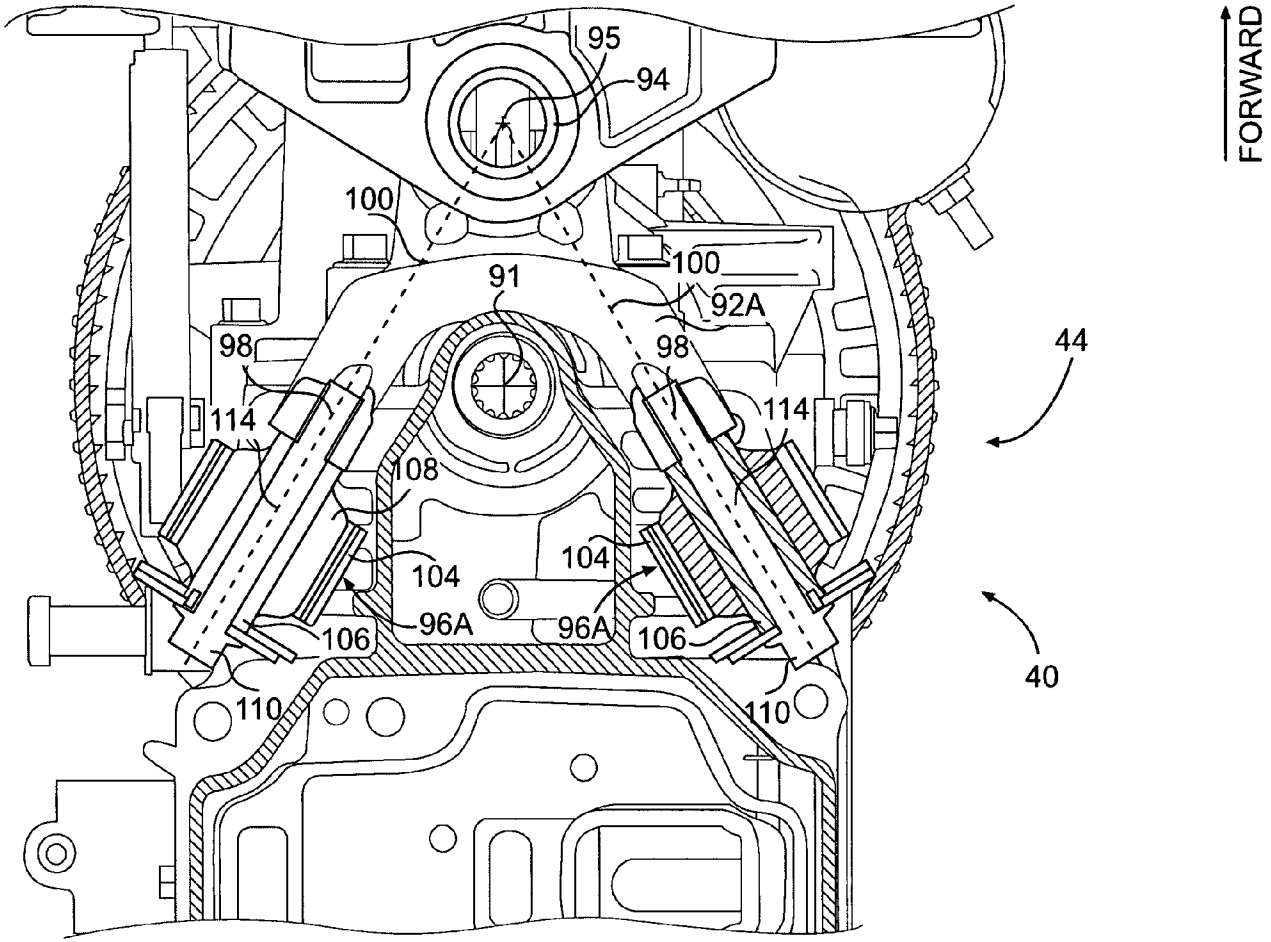
FIG. 5A is a cross-sectional view, taken through line A-A of FIG. 4, of the marine outboard engine of FIG. 2.
Figure 5B:
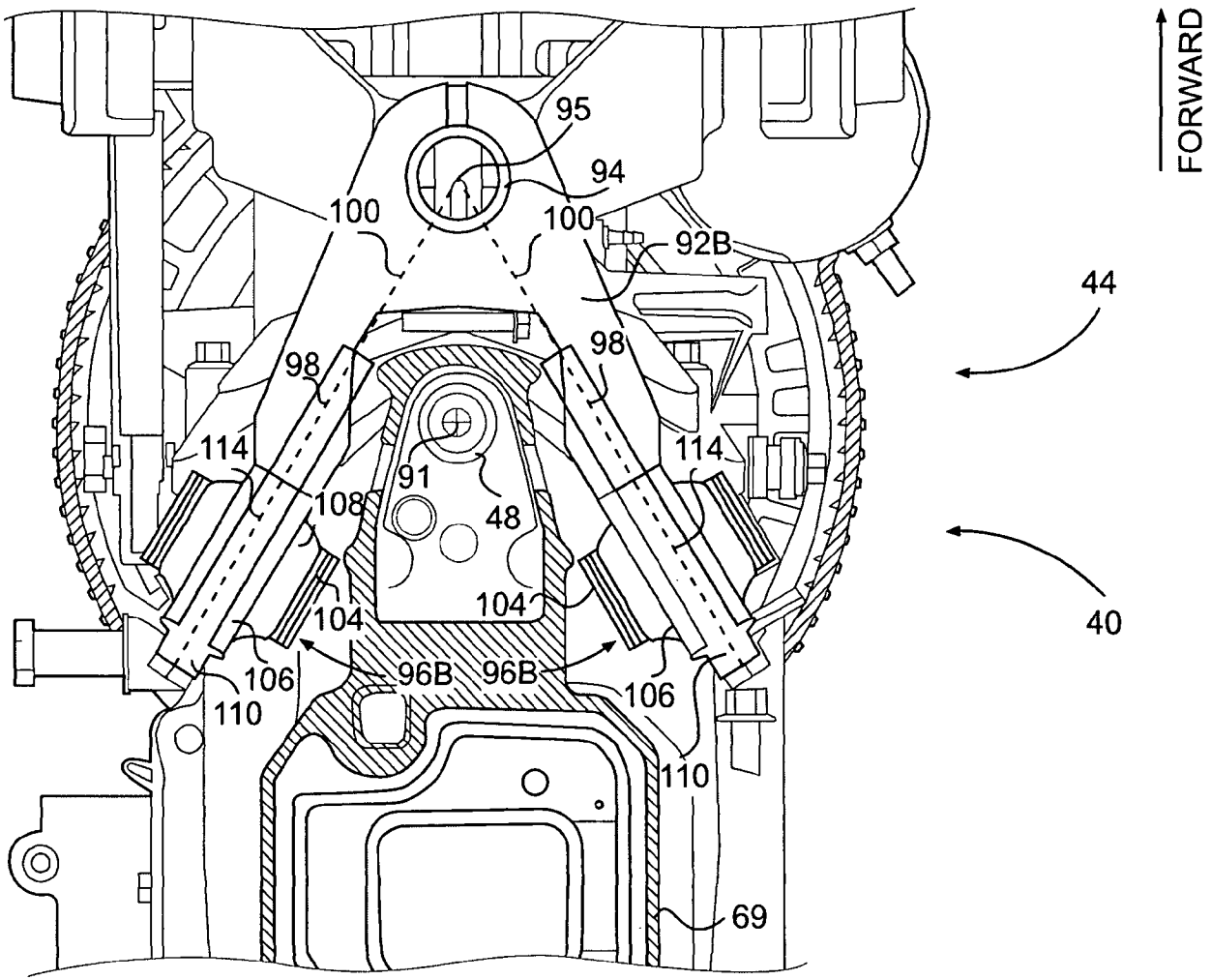
FIG. 5B is a cross-sectional view, taken through line B-B of FIG. 4 of the marine outboard engine of FIG. 2.
Figure 6:
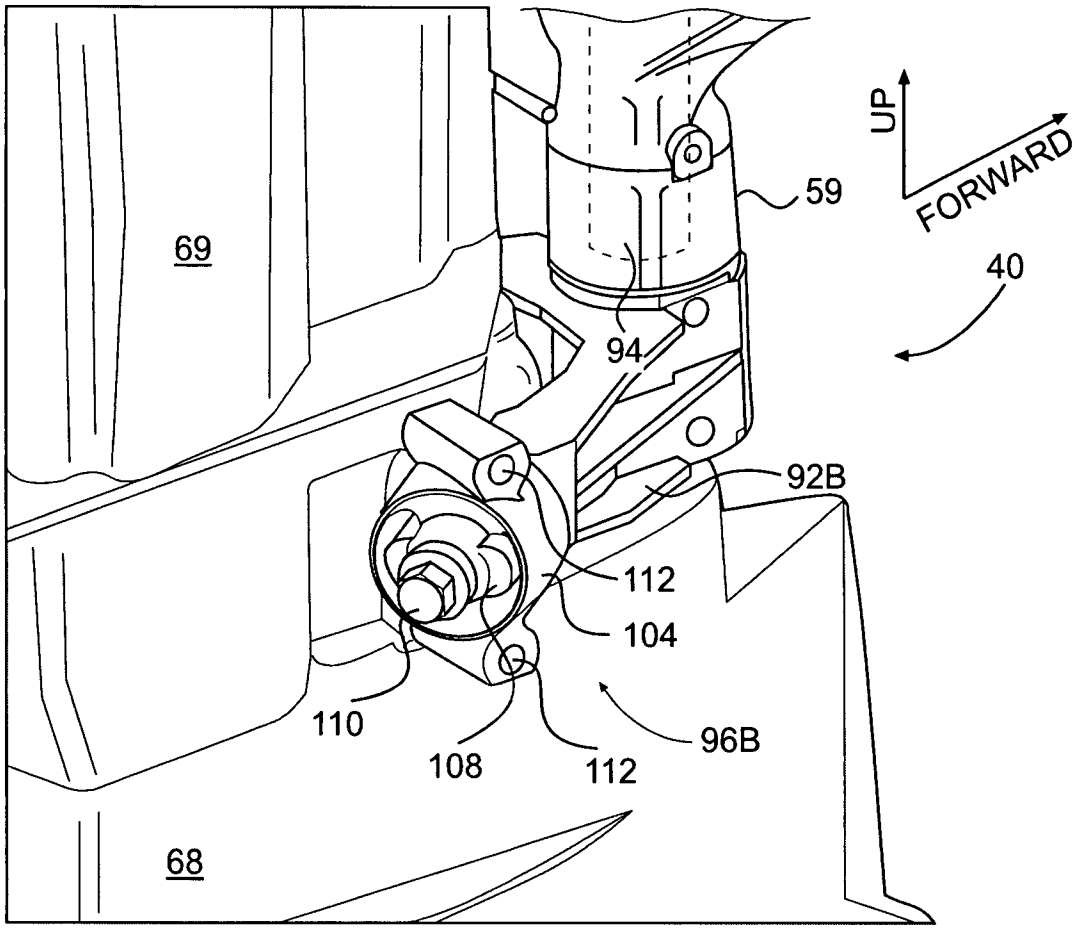
FIG. 6 is a close-up, perspective view, taken from a front, left side, of a lower engine mount of the marine outboard engine of FIG. 2.

Turning to FIGS. 4 to 6, details of the engine mount system will now be described. The engine mount system of the marine outboard engine 40 includes four engine mounts 96 (two upper engine mounts 96A and two lower engine mounts 96B) and two brackets 92 (upper bracket 92A and lower bracket 92B) Each of the engine mounts 96 has a primary axis 98 and a working axis 100 oriented as described with respect to FIG. 3. The two upper engine mounts 96A are connected to either side of the exhaust housing 69 (see FIG. 5A). The two upper engine mounts 96A are also connected to the upper bracket 92A which is pivotally connected to the upper end of the steering shaft 94. A portion of the upper bracket 92A extends forwardly of the steering shaft 94 and provides attachment points for the tiller 60 that is connected thereto. Similarly, the two lower engine mounts 96B are connected to either side of the exhaust housing 69 (see FIG. 5B). The two lower engine mounts 96B are also connected to the lower bracket 92B which is pivotally connected to the lower end of the steering shaft 94.

As best seen in FIG. 5B, each engine mount 96B includes an outer sleeve 104, an inner sleeve 106, a damper 108, and a fastener 110, all of which are disposed coaxially when the engine 44 is not in operation. The outer sleeve 104 is generally cylindrical in shape and includes two apertures 112 to receive fasteners (not shown) to fasten the engine mount 96B to the exhaust housing 69 (see FIG. 6). The inner sleeve 106 is generally cylindrical in shape and is disposed inside the outer sleeve 104. The outer and inner sleeves 104, 106 are preferably made of aluminium. The damper 108 is disposed between the outer and inner sleeves 104, 106 and is preferably bonded thereto. The material, shape, and density of the damper 108 at least in part determine the range of positions of the working axis 100. The damper 108 is preferably an elastomeric damper. The elastomeric material of the damper 108 is preferably natural rubber. Also, since the loads applied on the lower engine mounts 96B by the propeller 54 are higher than the loads applied on the upper engine mounts 96A by the propeller 54, the material of the dampers 108 of the lower engine mounts 96B is preferably harder than the material of the dampers 108 of the upper engine mounts 96A. As such, the natural rubber of the dampers 108 of the lower engine mounts 96B preferably has a hardness of 70 durometer and the natural rubber of the upper engine mounts 96A preferably has a hardness of 50 durometer. The hardness of the natural rubber is determined as per ASTM D 2240-05, "Standard Test Method for Rubber Property-Durometer Hardness", ASTM International, incorporated herein by reference. Each fastener 110 is disposed inside the inner sleeve 106 and extends into the lower bracket 92B. Preferably, the fastener 110 is a threaded fastener that engages threads in the lower bracket 92B. The inner sleeve 106 is held between the head of the fastener 110 and the lower bracket 92B and as a result, the engine mount 96B is fastened to the lower bracket 92B. The fastener 110 defines a fastener axis 114 that is coaxial with the primary axis 98 of the engine mount 96B. The upper engine mounts 96A have the same structure as the lower engine mounts 96B, as shown in FIG. 5A. The upper engine mounts 96A are also fastened to the upper bracket 92A and the exhaust housing 69 in the same way as the lower engine mounts 96B are fastened to the lower bracket 92B and the exhaust housing 69, also as shown in FIG. 5A. Therefore, the upper engine mounts 96A and the way in which they are connected to the other elements of the outboard engine 40 will not be described herein. It is contemplated that other types of engine mounts 96 could be used.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A marine outboard engine comprising:

a cowling;

an engine disposed in the cowling, the engine including:

a crankcase;

at least one cylinder connected to the crankcase; and a crankshaft disposed in the crankcase, the crankshaft defining a crankshaft axis;

a driveshaft disposed in the cowling generally parallel to the crankshaft axis, the driveshaft having a first end and a second end, the first end of the driveshaft being operatively connected to the crankshaft;

a gear case operatively connected to the cowling;

a transmission disposed in the gear case, the transmission being operatively connected to the second end of the driveshaft;

a propeller shaft disposed at least in part in the gear case generally perpendicular to the driveshaft, the propeller shaft being operatively connected to the transmission;

a bladed rotor connected to the propeller shaft;

a first engine mount operatively connected to a first side of the engine, the first engine mount defining a first engine mount working axis;

a second engine mount operatively connected to a second side of the engine, the second engine mount defining a second engine mount working axis;

a steering shaft operatively pivotally connected to the first and second engine mounts, the steering shaft defining a steering axis, the steering axis being generally parallel to the crankshaft axis, the first and second engine mount working axes being generally perpendicular to the steering axis, the first and second engine mount working axes passing through the steering shaft; and a stern bracket operatively pivotally connected to the steering shaft for mounting the outboard engine to a boat.

2. The marine outboard engine of claim 1, wherein the first and second engine mount working axes pass through the steering shaft when an engine speed is less than an engine transition speed.

3. The marine outboard engine of claim 2, wherein the engine transition speed is less than 3000 rpm.

4. The marine outboard engine of claim 1, wherein the first and second engine mount working axes pass through the steering axis.

5. The marine outboard engine of claim 1, further comprising an exhaust housing disposed in the cowling and connected to the engine; and wherein the first engine mount is connected to a first side of the exhaust housing and the second engine mount is connected to a second side of the exhaust housing.

6. The marine outboard engine of claim 5, further comprising a first bracket operatively pivotally connecting the steering shaft to the first and second engine mounts.

7. The marine outboard engine of claim 6, wherein the first bracket operatively pivotally connects a first end of the steering shaft to the first and second engine mounts; and further comprising:

a third engine mount connected to the first side of the exhaust housing, the third engine mount defining a third engine mount working axis;

a fourth engine mount operatively connected to the second side of the exhaust housing, the fourth engine mount defining a fourth engine mount working axis; and a second bracket operatively pivotally connecting a second end of the steering shaft to the third and fourth engine mounts;

wherein the third and fourth engine mount working axes are generally perpendicular to the steering axis and pass through the steering shaft.

8. The marine outboard engine of claim 7, further comprising a tiller connected to the first bracket.

9. The marine outboard engine of claim 1, wherein when the engine is in operation, the engine generates torque about a torque-roll axis;

wherein the torque-roll axis is generally parallel to the crankshaft axis; and wherein the torque-roll axis is generally perpendicular to the first and second engine mount working axes.

10. The marine outboard engine of claim 9, wherein the first and second engine mount working axes are spaced apart from the torque-roll axis.

11. The marine outboard engine of claim 6, wherein the first and second engine mounts each includes an elastomeric damper.

12. The marine outboard engine of claim 11, wherein the first and second engine mounts each further includes:

an outer sleeve;

an inner sleeve disposed inside the outer sleeve, the elastomeric damper being disposed between the outer sleeve and the inner sleeve; and a fastener disposed inside the inner sleeve; and wherein each fastener fastens its corresponding engine mount to the first bracket.

13. A marine outboard engine comprising:

a cowling;

an engine disposed in the cowling, the engine including:

a crankcase;

at least one cylinder connected to the crankcase; and a crankshaft disposed in the crankcase, the crankshaft defining a crankshaft axis;

a driveshaft disposed in the cowling generally parallel to the crankshaft axis, the driveshaft having a first end and a second end, the first end of the driveshaft being operatively connected to the crankshaft;

a gear case operatively connected to the cowling;

a transmission disposed in the gear case, the transmission being operatively connected to the second end of the driveshaft;

a propeller shaft disposed at least in part in the gear case generally perpendicular to the driveshaft, the propeller shaft being operatively connected to the transmission;

a bladed rotor connected to the propeller shaft;

a first engine mount operatively connected to a first side of the engine, the first engine mount having a first primary axis and including a first fastener, the first fastener defining a first fastener axis;

a second engine mount operatively connected to a second side of the engine, the second engine mount having a second primary axis and including a second fastener, the second fastener defining a second fastener axis;

a first bracket fastened to the first and second engine mounts by the first and second fasteners;

a steering shaft operatively pivotally connected to the first bracket, the steering shaft defining a steering axis, the steering axis being generally parallel to the crankshaft axis, the first and second primary axes being generally perpendicular to the steering axis, the first and second primary axes passing through the steering shaft; and a stern bracket operatively pivotally connected to the steering shaft for mounting the outboard engine to a boat.

14. The marine outboard engine of claim 13, wherein the first and second primary axes pass through the steering axis.

15. The marine outboard engine of claim 13, further comprising an exhaust housing disposed in the cowling and connected to the engine; and wherein the first engine mount is connected to a first side of the exhaust housing and the second engine mount is connected to a second side of the exhaust housing.

16. The marine outboard engine of claim 15, wherein the first bracket operatively pivotally connects a first end of the steering shaft to the first and second engine mounts; and further comprising:

a third engine mount connected to the first side of the exhaust housing, the third engine mount having a third primary axis and including a third fastener, the third fastener defining a third fastener axis;

a fourth engine mount operatively connected to the second side of the exhaust housing, the fourth engine mount having a fourth primary axis and including a fourth fastener, the fourth fastener defining a fourth fastener axis; and a second bracket fastened to the third and fourth engine mounts by the third and fourth fasteners, the second bracket being operatively pivotally connected to a second end of the steering shaft;

wherein the third and fourth primary axes are generally perpendicular to the steering axis and pass through the steering shaft.

17. The marine outboard engine of claim 16, further comprising a tiller connected to the first bracket.

18. The marine outboard engine of claim 13, wherein the first and second engine mounts each includes an elastomeric damper.

19. The marine outboard engine of claim 18, wherein the first and second engine mounts each further includes:

an outer sleeve; and an inner sleeve disposed inside the outer sleeve, the elastomeric damper being disposed between the outer sleeve and the inner sleeve; and wherein each of the first and second fasteners is disposed inside the inner sleeve of its corresponding engine mount.

20. The marine outboard engine of claim 13, wherein the first fastener axis is coaxial with the first primary axis; and wherein the second fastener axis is coaxial with the second primary axis.

21. The marine outboard engine of claim 13, wherein the first engine mount defines a first engine mount working axis;

wherein the second engine mount defines a second engine mount working axis;

wherein the first and second engine mount working axes are generally perpendicular to the steering axis; and wherein the first and second engine mount working axes pass through the steering shaft.

* * * * *